United States Patent [19]

Pelletier

[11] 4,231,309

[45] Nov. 4, 1980

[54] RUDDERS FOR BOATS, PARTICULARLY FOR PLEASURE BOATS

[75] Inventor: Jean Pelletier, Le Pradet, France

[73] Assignee: Coast Catamaran France S.A., Hyeres, France

[21] Appl. No.: 890,806

[22] Filed: Mar. 27, 1978

[30] Foreign Application Priority Data

Jul. 26, 1977 [FR] France ..... 77 22936

[51] Int. Cl.[3] ..... B63H 25/38

[52] U.S. Cl. ..... 114/162; 114/165

[58] Field of Search ..... 114/162, 163, 164, 165, 114/167, 169, 172

[56] References Cited

U.S. PATENT DOCUMENTS

| | | | |
|---|---|---|---|
| 3,575,124 | 4/1971 | Alter | 114/165 R |
| 4,046,093 | 9/1977 | Prindle | 114/165 |

*Primary Examiner*—Sherman D. Basinger

*Attorney, Agent, or Firm*—Cushman, Darby & Cushman

[57] ABSTRACT

A boat rudder comprises a rudder-blade hinged in its upper part to a substantially horizontal pin carried by a rudder-blade support, which support is hinged to a substantially vertical pin. The boat rudder further comprises a bar fixed to a bar support the rear part of which is hinged to the upper part of the rudder blade. A locking device, comprising a stop member carried by the bar support and a jamming member carried by the rudder-blade support, is provided for jamming the bar support in relation to the rudder-blade support. It is fitted with a balancing adjustment device for adjusting the normal working position of the rudder-blade and a longitudinal displacement arrangement for varying the distance between the stop member and the pin hinging the bar support to the rudder-blade.

12 Claims, 6 Drawing Figures

Fig.2.
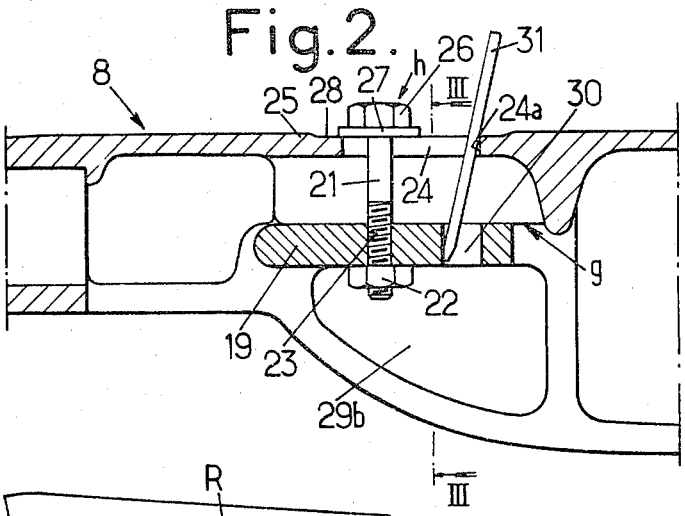
Fig.3.
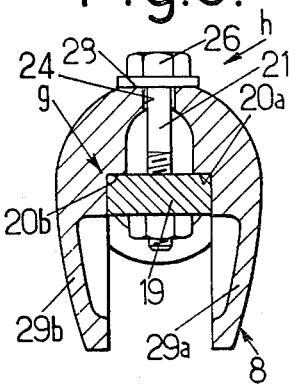
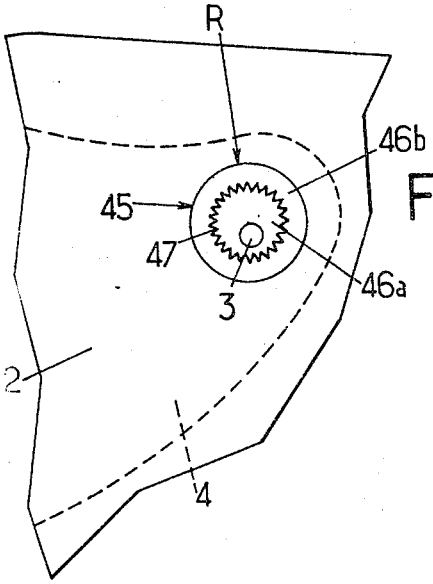
Fig.5.

RUDDERS FOR BOATS, PARTICULARLY FOR PLEASURE BOATS

The invention relates to boat rudders, particularly rudders for pleasure boats of the kind comprising:

- a rudder-blade hinged, at its upper part, to a substantially horizontal pin carried by a rudder-blade support, the latter being hinged about a substantially vertical pin situated at the rear of the boat and carried by gudgeons fixed to the boat;
- a bar fixed to a bar support, the rear part of this bar support being hinged to a substantially horizontal pin provided at the upper part of the rudder-blade;
- a locking device for jamming the bar support in relation to the rudder-blade support with the rudder-blade in a lower position corresponding to its normal working position, this locking device comprising a stop member, carried by the bar support, spaced longitudinally from the pin hinging the bar on the rudder-blade, said stop member being adapted to cooperate with a jamming member carried by the rudder-blade support, the assembly of the stop member and the jamming member being arranged so as to ensure automatic unlocking of the bar support in relation to the rudder-blade support when the stress exerted on the rudder-blade exceeds a given limit greater than the stresses likely to be exerted on the rudder-blade during normal sailing.

The invention is primarily concerned with rudders for pleasure boats of the catamaran or drop-keel type in which the automatic unlocking mentioned above generally is provided for automatic raising of the rudder-blade when the latter contacts an obstacle such as the bottom when the boat comes close to the shore.

It is known that when the boat is sailing, the rudder-blade of the rudder is subjected to stresses because of the relative displacement of the rudder in relation to the water. It is then necessary to exert a force on the bar to maintain it in a given angular position.

This force for maintaining the bar in position depends on a number of parameters such as the speed of the boat, its heading, etc. . . and, especially, on the balancing of the rudder.

This balancing depends primarily on the ratio between the two effective areas of the rudder-blade situated respectively in of and behind the substantially vertical rotational axis (or its extension) of the rudder-blade support.

The balancing of the rudder plays an important role and it is desirable to be able to adjust such balancing easily and accurately and to be able to adapt it to sailing conditions such as rake of the mast, strength of the wind or condition of the sea.

The balancing of the rudder has great importance in the case of boats, such as catamarans, which reach high speeds in the order of 20 knots, and which sail in very rugged conditions because of their robustness.

The invention has as its particular aim to provide rudders of the kind which answer better than heretofore known types to the different demands of use and which are especially easy to balance.

SUMMARY OF THE INVENTION

According to the invention, a boat rudder of the kind defined above is characterised by the fact that it is provided with a balancing adjustment device comprising:

- means for adjusting the normal working position of the rudder-blade in relation to the rudder-blade support, so that the ratio of the areas of the rudder-blade situated respectively in front and behind the hinge pin of the rudder-blade support (or its extension) may be adjusted;
- and longitudinal displacement means for varying the distance between said stop member and the pin hinging the bar support on the rudder blade, so as to set the locking according to the position of the rudder-blade determined by the above adjustment means.

Preferably, the means for adjusting the normal working position of the rudder-blade comprises an adjustable stop means provided between the rudder-blade support and the rudder-blade and arranged to permit adjustment of the angular position of the rudder-blade about the pin hinging it to the rudder-blade support.

The adjustable stop means may comprise an adjustment screw cooperating with a threaded hole provided in the rudder-blade support, the outer end of this screw cooperating with the edge of the rudder-blade.

The threaded hole for receiving the screw preferably is provided in the lower rear corner of the rudder-blade support. This hole preferably is oriented so that its axis is substantially perpendicular to the edge of the rudder-blade.

The stop member carried by the bar support is provided with a latch and the longitudinal displacement of this latch comprises means for guiding the longitudinal sliding of this latch and means for jamming and unjamming the latch in relation to the bar support, so that the latch may be placed, by sliding, in the appropriate position for locking at which position it is jammed.

The latch has a rectangular cross-section and the guide means is formed by shoulders having a right-angled section, adapted to cooperate with the upper and side edges of the latch, these shoulders being provided directly on the bar support and being particularly cast with this support.

The means for jamming and unjamming the latch comprises a bolt the threaded end of which cooperates with a threaded hole integral with the latch and the shank of which passes through an aperture elongated in the longitudinal direction and which is provided in the upper part of the bar support, the head of the bolt bearing against the upper surface of this bar support whereby tightening of the bolt ensures the jamming of the upper surface of the latch against the slides provided in the bar support.

Thrust means are provided for applying the latch against the jamming member at which point the latch is arrested in relation to the bar support through the jamming means.

According to one variation of the invention, the device for longitudinally displacing the stop member of the bar support in relation to the hinge pin of the bar support includes two parts rotatably mounted in the bar support and carrying, eccentrically, the pin hinging the bar support to the rudder-blade, the rotation of these parts causing the longitudinal displacement of said pin in relation to the stop member.

DETAILED DESCRIPTION OF THE INVENTION

The invention consists, apart from the arrangements outlined above, of certain other arrangements which will be more explicitly discussed hereafter in the description of particular embodiments illustrated by the accompanying drawings wherein:

FIG. 1 of these drawings is an elevational view, with certain parts cut away and other parts omitted, of a rudder according to the invention.

FIG. 2 is a view on a larger scale of a part of the bar support of the rudder of FIG. 1.

FIG. 3 is a sectional view along line III—III of FIG. 2.

FIG. 5, shows a variation of the means for adjusting the normal working position of the rudder-blade in relation to the rudder-blade support.

Figure 1:
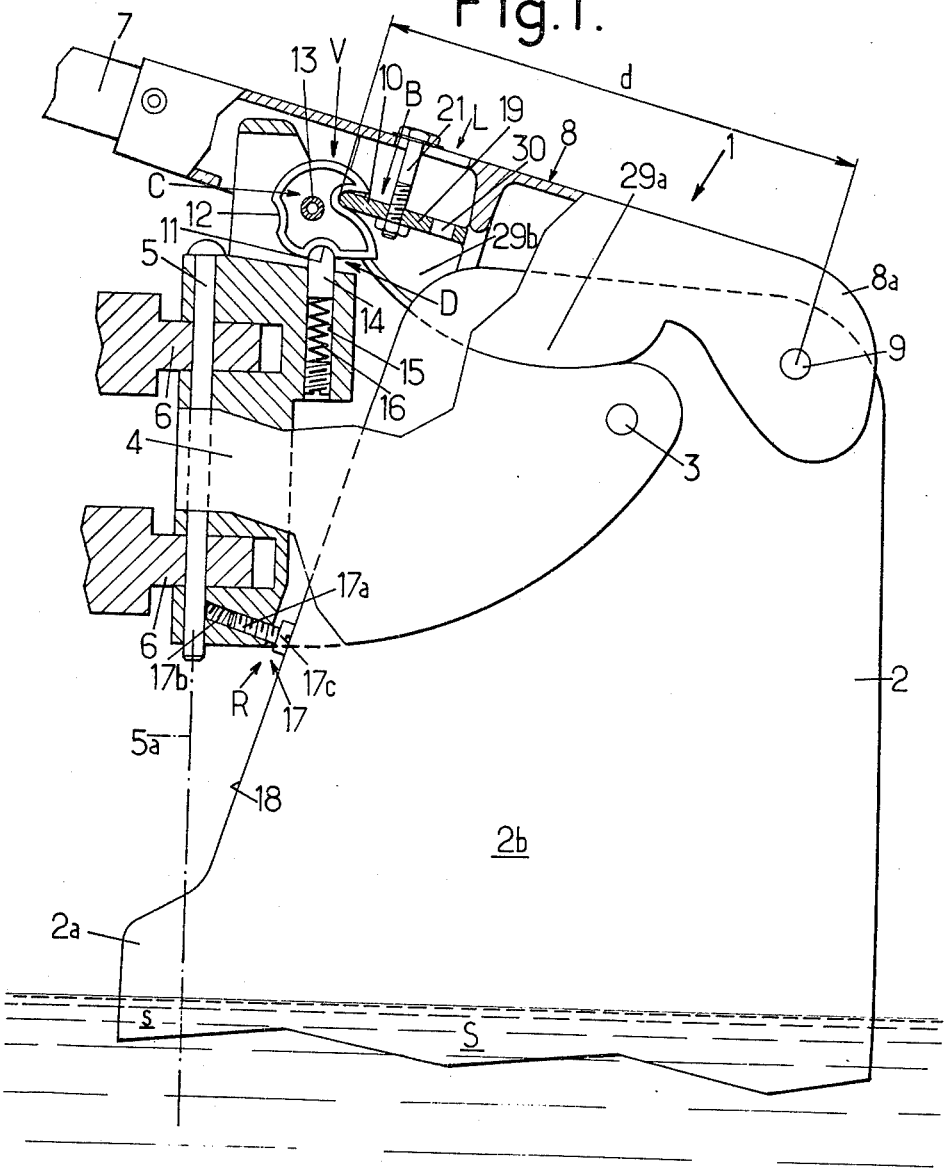

Referring to FIG. 1 of these drawings, there can be seen a boat rudder 1 comprising a rudder blade 2 hinged, at its upper part, to a substantially horizontal pin 3, carried by a rudder-blade support 4 which comprises two flanges or cheeks between which is engaged rudder-blade 2.

The support 4 is itself hinged about a substantially vertical pin 5 situated at the rear of the boat (not shown) and carried by gudgeons 6 fixed to the boat. A rudder of this kind is known and has been described, for example, in French Pat. No. 2,112,614 (national registration No. 70 39 439). For further details reference can be made to this patent.

The rudder further comprises furthermore a bar 7, only a part of which has been shown, which is fixed to a bar support 8. The rear part 8*a* of this bar support is hinged on a substantially horizontal pin 9. Pin 9 is carried by the upper rear part of rudder-blade 2 and is located behind pin 3 hinging the rudder-blade to the rudder-blade support, as can be readily seen in the drawing.

The major portion of rudder-blade 2 extends into the water for steering the boat. A fraction 2*a* of the area of rudder-blade 2 is situated in front of pin 5 (or of its extension 5*a*) for hinging support 4. The other fraction 2*b* of the area of the rudder blade is situated behind this extension 5*a*. If there is designated by s the submerged area of fraction 2*a* and by S the submerged area of fraction 2*b*, the ratio s/S determines the balancing of the rudder. The greater area s is in relation to area S, the less will be the force required to be exerted on bar 7 in order to maintain the rudder in position.

A locking device V is provided for jamming bar support 8 in relation to rudder-blade support 4 in the position shown in FIG. 1, which corresponds to the normal working position of the rudder-blade.

This locking device V comprises a stop member B carried by bar support 8 and spaced longitudinally from pin 9 hinging the bar support to rudder-blade 2. This stop member B is adapted to cooperate with a jamming member C carried by rudder-blade support 4. This jamming member C may be formed with notches such as 10, 11, 12, on its periphery, said part being rotatably mounted on a horizontal transverse pin 13 carried by the rudder-blade support 4. As is clearly shown in the drawing, the part forming jamming member C is introduced between the two cheeks of the rudder-blade support.

Stop member B cooperates with notch 10 when the rudder-blade 2 is in the normal working position.

Means D are provided for stopping the rotation of jamming member C in relation to rudder-blade support 4. These means D preferably are arranged so as to ensure automatic unjamming of bar support 8 in relation to rudder-blade support 4 when the stress exerted on rudder-blade 2 exceeds a given limit greater than the stresses likely to be exerted on the rudder-blade during normal sailing.

For this, the stop means D comprise a piston 14 adapted to slide in a bore 15 the axis of which is parallel to pin 5 and which is situated behind pin 5. Piston 14 is resiliently biased upwards by a spring 16 so as to cooperate with notch 11 of jamming member C. The upper end of piston 14 has a hemispherical shape for cooperating with notch 11 which has a corresponding shape.

It can thus be seen that piston 14 stops rotation of member C in relation to support 4. Accordingly, bar support 8, through the cooperation of stop member B with notch 10 of member C, is prevented from rotating about its axis 9 and is jammed. Rudder-blade 2 therefore also is jammed in its normal working position.

If, during sailing, rudder-blade 2 contacts an obstacle, particularly bottom when the boat is approaching the shore, the stresses exerted on the rudder-blade 2 become greater than a limit determined by the tension of spring 16, this limit being greater than stresses encountered during normal sailing. Rudder-blade 2 tends to rotate about pin 3 in a counterclockwise direction and pin 9 tends to advance, while causing the bar support 8 to be raised. The torque to which member C is subjected because of the thrust of stop member B, then becomes greater than the resistance afforded by piston 14 which cooperates with housing 11. Member C escapes from piston 14 by rotating in a counterclockwise direction. The result is the automatic unlocking of rudder-blade 2 and bar support 8.

The above explanations relate to known characteristics but are necessary to properly appreciate the invention which has the objective of enabling the ratio s/S, discussed hereabove, to be readily adjusted.

For this, there is provided means R for adjusting the normal working position of rudder-blade 2 in relation to rudder-blade support 4 and longitudinal displacement means L, mounted on bar support 8, for varying the distance d between the front end of stop member B and pin 9 hinging the bar support to the rudder-blade.

The adjustment of the working position of rudder-blade 2 allows the ratio of areas s and S to be modified, whereas the longitudinal displacement means L allow the locking to be set in accordance with the position of rudder-blade 2 determined by means R.

The adjustment means R comprises adjustable stop means 17 provided between rudder-blade support 4 and rudder-blade 2 and arranged so as to define the angular position (balancing angle) of the rudder blade about pin 3 hinging the blade to the rudder-blade support.

The adjustable stop means 17 comprise, advantageously, an adjustment screw 17*a* made from a non-corrodible material, e.g. a plastic material, stainless steel, titanium etc. . . This screw 17*a* cooperates with a threaded hole 17*b* provided in the lower rear corner of rudder-blade support 4.

The head 17*c* of the screw cooperates with the front edge 18 of the rudder-blade. As can be seen in FIG. 1, edge 18, in the zone where it bears against head 17*c*, is sloped in relation to pin 5. Threaded hole 17*b* is advantageously oriented so that its axis is substantially perpendicular to the edge 18 of the rudder-blade.

A lock-nut may be provided for jamming the screw in the threaded hole, this lock-nut not being shown in the drawing.

Stop member B is formed by a flat latch 19 capable of sliding in the longitudinal direction of bar support 8, and the means for the longitudinal displacement of this latch 19, in relation to hinge pin 9, comprises guide means g (see particularly FIGS. 2 and 3) and check means h for stopping latch 19 in relation to bar support 8.

Latch 19 has a rectangular cross-section, as can be seen in FIG. 3, and guide means g is formed by shoulders 20*a*, 20*b* (FIG. 3) having a right-angled cross-section and adapted to cooperate with the upper longitudinal edges and with the lateral edges of latch 19. These shoulders 20*a* and 20*b* are provided directly on bar support 8 and may be cast with this bar support.

Check means h of the latch comprises a bolt 21 (FIG. 2) the threaded end of which cooperates with a nut 22 integral with the latch and placed under the lower surface thereof. Bolt 21 passes through a hole 23 provided in the latch. According to a variation of this embodiment, instead of providing a nut 22 integral with latch 19, hole 23 is threaded so that the threaded part of bolt 21 cooperates directly with the threaded hole.

The shank of bolt 21 passes through an oblong aperture 24 provided in the upper wall 25 of bar support 8. The large dimension of aperture 24 is oriented in the longitudinal direction of bar support 8. The transverse dimension of aperture 24, as can be seen in FIG. 3, is less than the diameter of head 26 of bolt 21. This head 26 bears, preferably through a washer 27, against the upper surface of bar support 8. The bearing zone of washer 27, as can be seen in FIG. 3, is formed by the flat surface 28 provided on the upper part of the bar support. As can be seen in FIG. 3, this bar support 8 has a cross-section the shape of which is rounded at its upper part, and which is open at its lower part between two lateral cheeks 29*a* and 29*b* of support 8. The top part of rudder-blade 2 is introduced between the two cheeks 29*a* and 29*b*.

Latch 19 comprises at its rear part a hole 30 adapted to receive the end of a tool 31, such as a screw-driver or a metal rod, introduced through the rear part of the oblong aperture 24. By causing this tool 31 to bear against the rear edge 24*a* of aperture 24, and by using it as a lever, a forward thrust can be exerted on latch 19 so as to provide a good contact in notch 10 when latch 19 is unjammed after loosening bolt 21. The oblong aperture 24 has a length greater than the longitudinal adjustment travel of latch 19, sufficiently greater than the travel of bolt 21 so that a passage always exists for tool 31, at the rear of the latch, between bolt 21 and edge 24*a*.

The jamming of the latch after it has been properly positioned is obtained by tightening bolt 21 in nut 22, so that the upper edges of the latch are jammed against the transverse faces of guide shoulders 20*a* and 20*b*.

It is to be noted that shoulders 20*a* and 20*b* provide vertical and lateral guiding of latch 19. This latch is sufficiently long to seat correctly inside the shoulders avoiding any wedging effect.

Latch 19 is made from material which resists corrosion by sea-water. When this latch is made from aluminum or a plastic material, for example, if a threaded hole is provided in the latch for cooperating with bolt 21, this threaded hole comprises advantageously an insert with interior threads. This insert also may be of the self-locking type with an incorporated thread-lock. The jamming can also be achieved by means of a lock-nut, particularly one made from stainless steel.

Bolt 21 may be of the hexagonal head type or of the hexagonal socket type formed from a material resisting corrosion, e.g. stainless steel.

Instead of bolt 21 there could be provided a stud made integral with latch 19 by any appropriate means, e.g. welding, crimping, sticking. The threaded part of this stud would then pass through aperture 24, and a nut bearing against the upper surface of the bar support would provide jamming.

It should also be noted that instead of using a tool 31 for exerting a thrust on latch 19, a screw or a threaded pin could be provided which is oriented in the longitudinal direction, situated behind the latch and adapted to exert a thrust on the latch. This screw or pin would bear on bar support 8 and its movement would be controlled by a relative rotational movement, e.g. by a nut jammed in translation.

Figure 4:
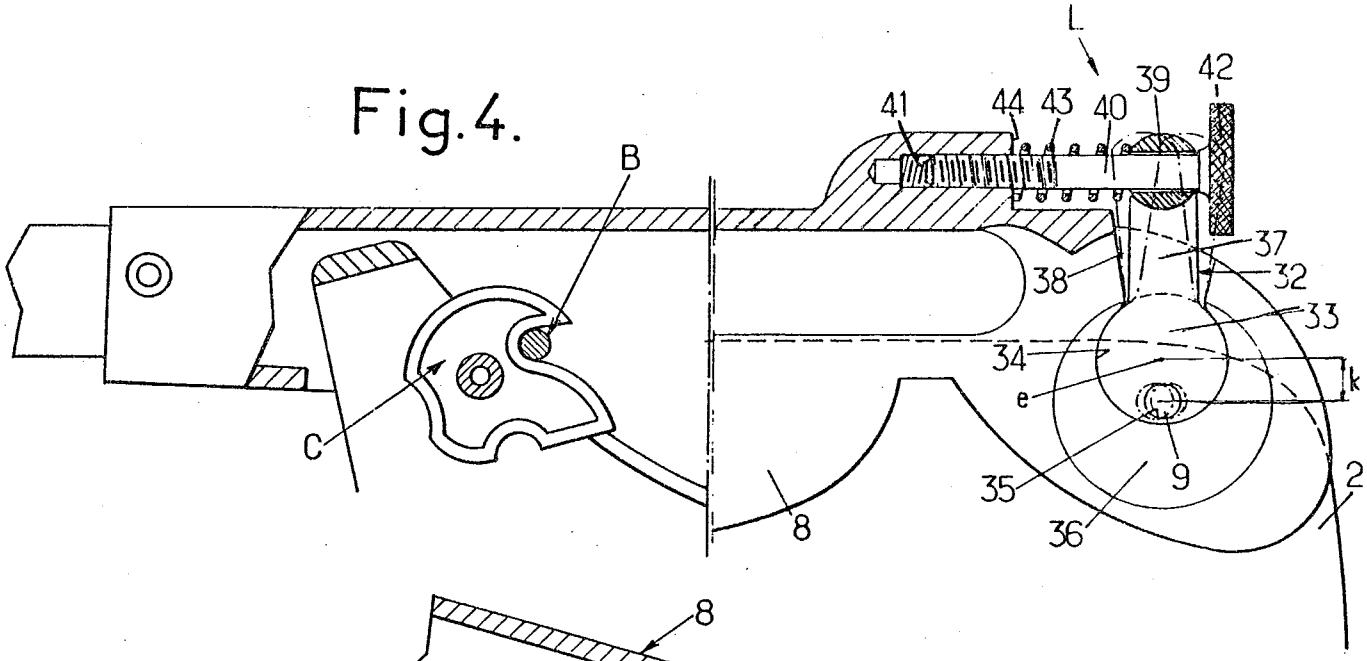
FIG. 4 shows a variation of the longitudinal displacement means.
Figure 6:
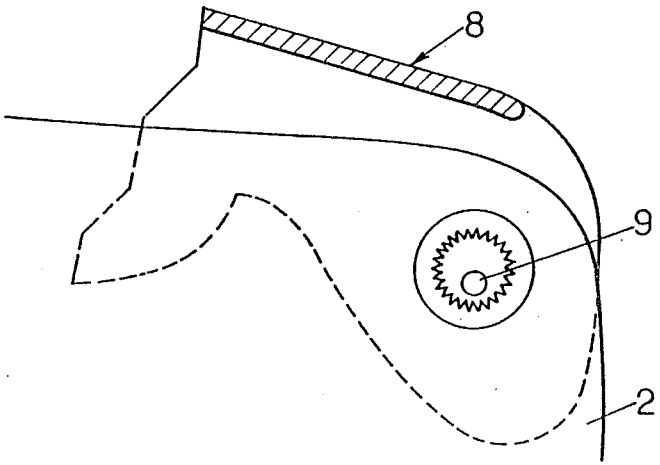
FIG. 6 illustrates a further variation of the longitudinal displacement means.

In FIG. 4, there is shown a variation of the device for the longitudinal displacement of stop member B in relation to bar support 8.

In the arrangement according to FIG. 4, stop member B is formed by a part, such as a transverse rod, having a fixed position in relation to bar support 8. The longitudinal displacement means L, according to the arrangement of FIG. 4, is arranged to move the hinge pin 9 of the bar support in relation to the stop member.

To achieve this, pin 9 is supported by two supporting pieces, such as 32, provided with a circular part 33 housed in a circular housing 34 located inside each lateral cheek of bar support 8 and not visible from outside. Circular part 33 is mounted so as to be able to rotate about the center e of housing 34. A bore 35, offset in relation to e, is provided to receive pin 9. This bore 35 has its center situated substantially vertically below center e. The distance between point e and pin 9 is designated by k. Circular housing 34 may be provided in a part 36 inserted inside each cheek of bar support 8.

Piece 32 also comprises an arm 37 extending upwards from circular part 33, this arm 37 passing freely through an aperture 38 provided in the cheek of bar support 8 so as to allow sufficient swing for desired adjustments of arm 37.

The two arms 37 of pieces 32 associated with respective cheeks of bar support 8 are connected at their upper ends by a floating transverse element 39, preferably made from stainless steel, through which passes an adjustment screw 40 oriented in the longitudinal direction and having a threaded end which cooperates with a threaded hole 41 provided in the upper part of the bar support. The rear end of the screw comprises a knurled knob 42. A spring 43 is compressed between transverse element 39 and an abutment wall 44 provided in bar support 8 for maintaining element 39 against knob 42. This spring serves also as a thread-lock.

Hole 41 may be reinforced by any conventional means such as a helical insert or the like.

It can immediately be seen (as viewed in FIG. 4) that by screwing screw 40 into threaded hole 41, part 32 is rotated, in a counterclockwise direction about point e which causes a rearward movement of pin 9. This movement is achieved along an arc of a circle substantially merging with the longitudinal direction. Unscrewing of screw 40 causes a movement of pin 9 in the opposite direction.

Such being the case, the adjustment of the balancing of a rudder according to the invention is achieved in the following manner.

The adjustment of the balancing angle is carried out first of all by adjustment of the angular position of the rudder-blade about pin 3 which hinges it to rudder-blade support 4.

For this, the position of the stop point is adjusted as determined by head 17*c* of screw 17. This adjustment is obtained by screwing in or out screw 17 this being a precise micrometric adjustment which may be effected from the outside without disassembly.

It can be immediately seen that by varying the balancing angle, the ratio of areas s/S varies, the result being a modification of the balancing. When rudder-blade 2 rotates about pin 3 in a clockwise direction (as viewed in FIG. 1), the ratio s/S increases.

It should be noted that during sailing of the boat, all the stresses exerted by the pressure of the water at high speeds on the rudder-blade, as well as impact of the rudder-blade against an obstacle, such as against the bottom, tend to move rudder-blade 2 away from stop screw 17. This screw is not therefore subjected to great stresses and does not need to be of a large size.

When the ideal balancing angle has thus been adjusted with precision, it is then necessary to adjust the locking of the bar support 8 and thus the rudder- blade 2, in a normal lowered position. In fact, during adjustment of the balancing angle, the position of pin 9 in relation to pin 3 is modified as it also is in relation to rudder-blade support 4 and to jamming member C. The adjustment for locking, when the stop member B is formed by a sliding latch such as 19 (FIGS. 1 to 3), is extremely simple.

The latch is unjammed by unscrewing bolt 21. Then by means of tool 31 introduced in the rear part of oblong aperture 24 and engaging the rear hole 30 of latch 19, a forward thrust is exerted on the latch so as to move it firmly into notch 10 of jamming member C.

While maintaining the thrust on latch 19, bolt 21 is tightened to jam the latch.

Thus locking without play is obtained.

During sailing of the boat, the thrust of the water on the rudder-blade creates a torque tending to rotate rudder-blade 2 in a counterclockwise direction about pin 3, as viewed in FIG. 1. Latch 19 then exerts a thrust into notch 10 of jamming member C, while maintaining rudder-blade 2 in position.

In the case of the variation of FIG. 4, the adjustment of the locking, after adjustment of the balancing angle, is obtained by longitudinal displacement of pin 9 by rotating pieces 32 in a suitable direction through actuation of the knurled knob 42 of screw 40.

With a rudder made in accordance with the invention, it is possible to adjust its balance, in accordance with the liking of the helmsman, so as to adapt it to the rake of the mast, the strength of the wind or the condition of the sea.

It should be noted that the particular embodiments which have been described correspond to simple solutions.

Other solutions however are possible.

For example, instead of screw 17 for adjusting the position of the stop point of rudder-blade 2 on the lower and inner corner of rudder-blade support 4, a cam could be provided passing through the rudder-blade in its lower inner corner and on which would abut the edge 18 of the rudder-blade. This cam would be visible on both sides of the rudder-blade and could be easily adjustable from the outside, for example, with the help of a screw-driver, for turning the cam into an angular position corresponding to a desired balancing angle for rudder-blade 2.

According to other possibilities, instead of adjusting the position of the stop point of edge 18 of the rudder-blade against the rudder-blade support, the position of the hole provided in the rudder- blade, and through which passes the hinge pin on the rudder-blade support, could be varied. This variation of position of the hole could be obtained, as shown in FIG. 5, by including in the rudder-blade 2 an insert 45 comprising two concentric parts, 46*a*, 46*b*. The inner part 46*a* includes a hole through which passes pin 3, this hole being offset in relation to the center of the two concentric parts 46*a*, 46*b*. Jamming means formed, for example, by mating serrations 47, would allow the inner part 46*a* to be jammed in relation to the outer concentric part 46*b* at a given angular position which would correspond to a variable longitudinal position of the hole through which pin 3 passes. Alternatively, the position of pin 3 carried by rudder-blade support 4 could be varied. This variation of position could be obtained by providing two cams in the two cheeks of the rudder-blade support 4 on each side of rudder-blade 2.

Likewise, in the case of the longitudinal displacement means for stop member B in relation to pin 9 which hinges the bar support 8 on the rudder-blade, other solutions than those described are possible.

For example, an insert, similar to the insert 45 of FIG. 5, could be placed in rudder-blade 2 for allowing the displacement of the hole which is provided in rudder-blade 2 for receiving the pin 9 to hinge the blade on the bar support.

Varying the position of jamming member C carried by rudder-blade support 4 also is possible.

What is claimed is:

1. A boat rudder comprising:

a rudder-blade hinged, in its upper part, to a substantially horizontal pin carried by a rudder-blade support, itself hinged about a substantially vertical pin, situated at the rear of the boat and carried by gudgeons fixed on this boat;

a bar fixed to a bar support, the rear part of this bar support being hinged to a substantially horizontal pin provided at the upper part of the rudder-blade;

a locking device for jamming the bar support in relation to the rudder-blade support, in a lower position of the rudder-blade corresponding to the normal working position, this locking device comprising a stop member, carried by the bar support, spaced longitudinally from the pin hinging the bar on the rudder-blade, said stop member being adapted to cooperate with a jamming member carried by the rudder blade support, the assembly of the stop member and the jamming member being arranged so as to ensure automatic unlocking of the bar support in relation to the rudder-blade support when the stress exerted on the rudder-blade exceeds a given limit greater than the stresses likely to be exerted on the rudder-blade during normal sailing, characterised by the fact that it is provided with a balancing adjustment device comprising:

means for adjusting the normal working position of the rudder-blade with respect to the rudder-blade support so that the ratio of the areas of the rudder blade situated respectively in front and behind the hinge pin of the rudder-blade support (or its extension) may be adjusted;

and longitudinal displacement means for varying the distance between said stop member and the pin for hingeing the bar support on the rudder-blade, so as to set the locking in accordance with the position of the rudder-blade determined by the above adjustment means.

2. A rudder according to claim 1, characterised by the fact that the means for adjusting the normal working position of the rudder-blade comprises adjustable stop means provided between the rudder-blade support and the rudder-blade, and arranged for adjusting the angular position of the rudder-blade about the pin hingeing it to the rudder blade support.

3. A rudder according to claim 2, characterised by the fact that the adjustable stop means comprises an adjustment screw cooperating with a threaded hole provided in the rudder-blade support, the outer end of this screw cooperating with the edge of the rudder-blade.

4. A rudder according to claim 3, characterised by the fact that the threaded hole for receiving the screw is provided in the lower rear corner of the rudder-blade support, this hole being particularly turned so that its axis is substantially perpendicular to the edge of the rudder-blade.

5. A rudder according to claim 1, characterised by the fact that the stop member carried by the bar support is formed by a sliding latch and that the means for the longitudinal displacement of this latch comprises means for guiding the longitudinal sliding of this latch and means for jamming and unjamming the latch in relation to the bar support, so that this latch may be placed by sliding, in the appropriate position for locking, a position in which it is jammed.

6. A rudder according to claim 5, characterised by the fact that the latch has a rectangular cross-section and the guide means are formed by shoulders each having a right-angled section, adapted for cooperating with the upper and side edges of the latch, these shoulders being provided directly on the bar support.

7. A rudder according to claim 5, characterised by the fact that the means for jamming and unjamming the latch comprises a bolt whose threaded end cooperates with a threaded hole integral with the latch and whose shank passes through an aperture elongated in the longitudinal direction, provided in the upper part of the bar support, the head of the bolt bearing against the upper surface of this bar support, the tightening of the bolt ensuring jamming of the upper surface of the latch against shoulders provided in the bar support.

8. A rudder according to claim 7, characterised by the fact that thrust means are provided for applying the latch against the jamming member for, then, stopping the latch in relation to the bar support, through the jamming means.

9. A rudder according to claim 1 in which the stop member is fixed in relation to the bar support, characterised by the fact that the longitudinal displacement device for the stop member of the bar support, in relation to the hinge pin of the bar support, comprises two parts rotatably mounted in the bar support and carrying, eccentrically, the pin hinging the bar support to the rudder-blade, the rotation of these parts causing the longitudinal displacement of the pin in relation to the stop member.

10. A rudder according to claim 9, characterised by the fact that the rotation of the parts is controlled by a screw, fitted with a knurled knob, cooperating with a transverse element connecting said parts and whose threaded part is engaged in a threaded hole provided in the bar support

11. A rudder according to claim 1 characterised by the fact that the means for adjusting the normal working position of the rudder-blade comprises an insert included in the rudder-blade, said insert comprising two concentric parts, with an inner part comprising a hole through which passes a pin supported by the rudder-blade support, said hole being offset in relation to the centre of the two concentric parts, jamming means being provided between the inner part and an outer concentric part for allowing the inner part to be jammed in relation to the outer concentric part in a given angular position to which would correspond a variable longitudinal position of the hole through which passes said pin.

12. A rudder according to claim 1 characterised by the fact that the longitudinal displacement means for varying the distance between said stop member and the pin for hinging the bar support comprises an insert included in the rudder-blade for allowing the displacement of a hole through which passes the pin for hingeing the bar support, said insert comprising two concentric parts, with an inner part comprising the hole, said inner part being angularly adjustable in relation to an outer concentric part, said hole being offset in relation to the centre of the two concentric parts.

* * * * *